US006550410B2

(12) United States Patent
Reimers

(10) Patent No.: US 6,550,410 B2
(45) Date of Patent: Apr. 22, 2003

(54) SYSTEM AND METHOD FOR STORAGE AND CONVEYANCE OF FLUIDS, AND A METHOD FOR FILLING AND EMPTYING A COLLAPSIBLE FLUID CONTAINER

(75) Inventor: Jan Otto Reimers, Oslo (NO)

(73) Assignee: Nordic Water Supply ASA, Oslo (NO)

( * ) Notice: Subject to any disclaimer, the term of this patent is extended or adjusted under 35 U.S.C. 154(b) by 32 days.

(21) Appl. No.: 09/731,695

(22) Filed: Dec. 8, 2000

(65) Prior Publication Data

US 2002/0073907 A1 Jun. 20, 2002

(51) Int. Cl.[7] ..... B65D 88/78
(52) U.S. Cl. ..... 114/256; 114/74 T
(58) Field of Search ..... 114/257, 74 T, 114/242, 244, 245, 249, 253

(56) References Cited

U.S. PATENT DOCUMENTS 3,648,643 A * 3/1972 Murray ..... 114/244
3,779,196 A * 12/1973 Knaus et al. ..... 114/74 T
4,108,101 A * 8/1978 Schirtzinger ..... 114/245
5,235,928 A * 8/1993 Shank, Jr. ..... 114/244

FOREIGN PATENT DOCUMENTS

DE 2916489 * 11/1980 ..... 114/256

* cited by examiner

*Primary Examiner*—Ed Swinehart
(74) *Attorney, Agent, or Firm*—Young & Thompson

(57) ABSTRACT

A system and method for storing and conveying (e.g. towing) fluids. The system includes a collapsible fluid container with an elongate shape and a first and a second end. A flexible fluid conduit is fixedly attached to the front end of the container. A towing/mooring device is attached to the conduit. A retarder/mooring device is attached to the container second end. The system also includes container retrieval, storage and deployment devices.

23 Claims, 8 Drawing Sheets

SYSTEM AND METHOD FOR STORAGE AND CONVEYANCE OF FLUIDS, AND A METHOD FOR FILLING AND EMPTYING A COLLAPSIBLE FLUID CONTAINER

BACKGROUND OF THE INVENTION

1. Field of the Invention

The present invention relates to the field of storing and conveying fluids, and more particularly, to an improved system and method for storing and conveying fluids, such as potable water, by means of a collapsible, floating and towable container. Furthermore, this invention relates to methods for filling and/or emptying and retrieving and/or deploying such containers.

2. Description of the Related Art

Although approximately two thirds of the surface of the Earth is covered by water, many areas and regions around the world are severely affected by the lack of this fundamental natural resource. People living in regions in the Middle East and in Northern Africa are today in need of reliable water supply for nutrition (food and drink), irrigation (agriculture) and sanitation purposes. Also, large areas in Asia, China and the Americas are threatened by lack of water, due to high population density compared to the available local water resources. Furthermore, local water resources in several areas are unfit for human use, due to pollution and contamination.

In addition to the aforementioned uneven distribution of water as such, fresh water, i.e. water suitable for e.g. human and animal consumption and sanitary use, is even more scarce on a world wide basis. Only about 3.5% of the Earth's surface water is fresh water, and almost all of that fresh water is in the form of ice, predominantly in the Arctic and Antarctic regions. According to Philip Ball, author of "$H_2O$: A Biography of Water" (Weinfelds and Nicolson, 1999, ISBN 0 297 64314 2), only approximately 0.01% of the Earth's fresh water is in a form available for human and animal use, in the form of lakes, streams, rivers and groundwater aquifers. However, only half of this amount is directly accessible. Scientists have estimated that the global population presently is using more than half of the accessible fresh water. If the current trends persist, scientists predict, the demand for water on a global basis might exceed the total available supply by around the year 2030.

Despite substantial wide efforts to improve fresh water accessibility, including e.g. water management programs and desalination, there is still a need for a redistribution of water supplies. Although solar power will contribute to lowering the cost of desalination, this process is still very energy demanding and thus prohibitively costly for many third world countries.

In one type of redistribution effort, water is transported by sea over considerable distances, by means of ocean going tankers and barges. This method is very expensive, however, and can only handle relatively small volumes. One other means of transporting fresh water, which is considerably less expensive, is the use of large bags which are towed in a semi-submersed state, by one or more tugs. Commercial operations using such bags have been established; one example being the ongoing shipment of fresh water from Turkey to Northern Cyprus, undertaken by the applicant for the present invention.

As the process of transporting water in floating and towable fabric bags is still fairly new, the associated technology is still not developed to a satisfactory state. Examples of shortcomings with the present water bag technology, are poor fabric rupture control, cumbersome hose pull in- and connection procedures, inadequate towing capabilities and retarding/mooring problems.

Prior art water bags have no means for controlling or limiting fabric rupturing. Thus, a tear occurring in prior art bags may very rapidly propagate along a substantial length of the bag, leaving no option for the operator but to discard the bag. Repairing extensive tears is prohibitively costly.

Prior art water bags are towed by the connector element, which is attached to the front end of the bag. Thus, the operation of connecting and/or disconnecting prior art water bags to water filling- and/or discharge facilities, involves the launching of a filler/discharge hose from the filling/discharge facility, and performing the connection/disconnection in the sea. This operation is cumbersome, time-consuming, labor demanding and unreliable.

Prior art water bags are, while on tow and due to their considerable mass, in certain situations difficult to maneuver and control. This is a particularly crucial problem when the water bag needs to be decelerated and brought to a complete stop prior to connection to the onshore facility. Prior art water bags lack adequate means for retarding prior to connection, and also for adequate mooring during fresh water filling or discharge.

It is therefore a long felt need for an improved system for transporting large quantities of water over considerable distances, at affordable costs.

The present invention solves that need, in that it provides a system and method for transporting fluids in towable, floating bags, which provides better rupture control, improved handling characteristics and quicker pull in- and connection operation. Additionally, the invention provides novel methods for filling and emptying such water bags in order to ensure that the water bags do not sink to the seabed before, during and after filling.

BRIEF SUMMARY OF THE INVENTION

These and other objects and features of the invention are provided by an improved system for storing and conveying fluids, where the system is adapted for towing by marine crafts in offshore conditions. In general, the system comprises:

- a collapsible fluid container with an elongate shape and a first and a second end;
- a fluid conduit fixedly attached to the front end of the container;
- towing/mooring means fixedly attached to said conduit;
- retarder/mooring means attached to said container second end; and
- container retrieval, storage and deployment means.

Furthermore, an improved system and method for towing collapsible, floating, fluid containing containers is provided, where such system for towing comprises a fluid filling and emptying conduit attached to said container first end, and towing means attached to said conduit, and where the method comprising the towing of said container by means of pulling a fluid filling and emptying conduit attached to said container first end.

Furthermore, it is provided a method for emptying and retrieving a collapsible fluid container filled with a volume of fresh water, thus:

- while the conduit is attached to an emptying facility, attaching the container second end to a container retrieval storage and deployment means removeably mountable on a vessel intended for the transportation of said container in an empty state;

coordinated with the discharge of said fresh water through said conduit, reeling said container onto said retrieval, storage and deployment means;

coordinated with the reeling of said container onto said retrieval, storage and deployment means, propelling said vessel in a direction generally towards said facility; and when said container is sufficiently empty, releasing said hose from said facility, thereby enabling the part of said container and said hose still in the water to be completely retrieved onto said retrieval, storage and deployment means, whereby said method effectively causes virtually said entire volume of fresh water to be emptied from said container.

Furthermore, it is provided a method for deploying of, and filling with an volume of fresh water, a collapsible fluid container, thus:

pulling the conduit off a container retrieval, storage and deployment means removeably mountable on a vessel intended for the transportation of said container in an empty state;

connecting said conduit to a filling facility and commencing a filling of fresh water through said conduit and into said container;

coordinated with the filling of said fresh water through said conduit, reeling said container off said retrieval, storage and deployment means;

coordinated with the reeling of said container off of said retrieval, storage and deployment means, propelling said vessel in a direction generally away from said facility; and when said container is sufficiently filled with fresh water, releasing said container second end from said retrieval, storage and deployment means.

Preferred embodiments are contained within the accompanying claims.

Other features, features and advantages of the present invention will be readily apparent to those skilled in the art upon a reading of the description of a preferred embodiment which follows, when taken in conjunction with the accompanying drawings.

BRIEF DESCRIPTION OF THE DRAWINGS

FIG. 6A shows a basic joint configuration and FIG. 6B shows a configuration where an additional sealing profile is provided.

DETAILED DESCRIPTION OF THE INVENTION

Figure 1A:
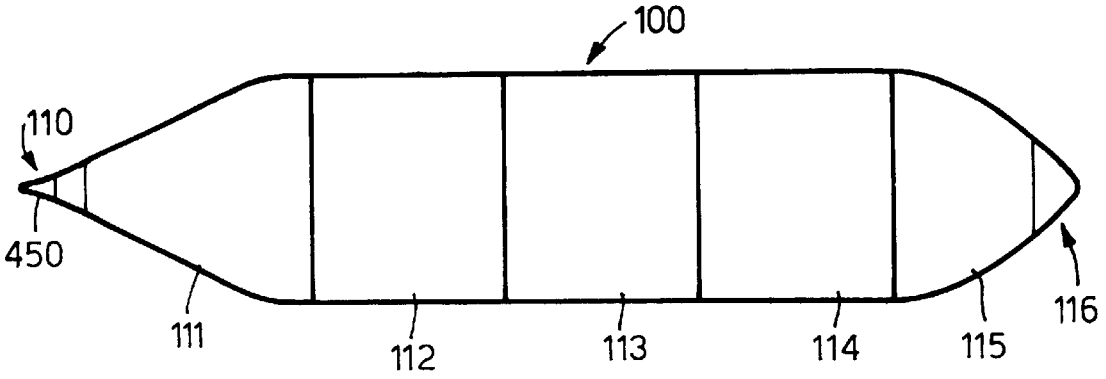
FIGS. 1A and 1B is a plan view and a cross sectional view, respectively, of the collapsible fluid container according to an embodiment of the present invention.
Figure 1B:
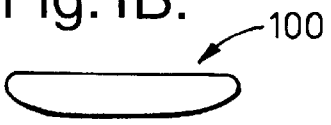

Referring to FIGS. 1–10, a preferred embodiment of the system according to the present invention comprises a bag 100 suitable for the storage and transportation of fluids such as potable water. The bag 100 is made up of a number of modules, or sections 110, 111, 112, 113, 114, 115, 116. For a typical configuration, the total bag length may be around 160 meters, and each of the center sections may be approximately 30 meters long. The bag width in a filled state is approximately 35 meters, and the draft about 7 meters. FIG. 1A is a plan view of the water bag, and displays the general mavicular shape of the bag. FIG. 1B shows a bag cross section.

Figure 2A:
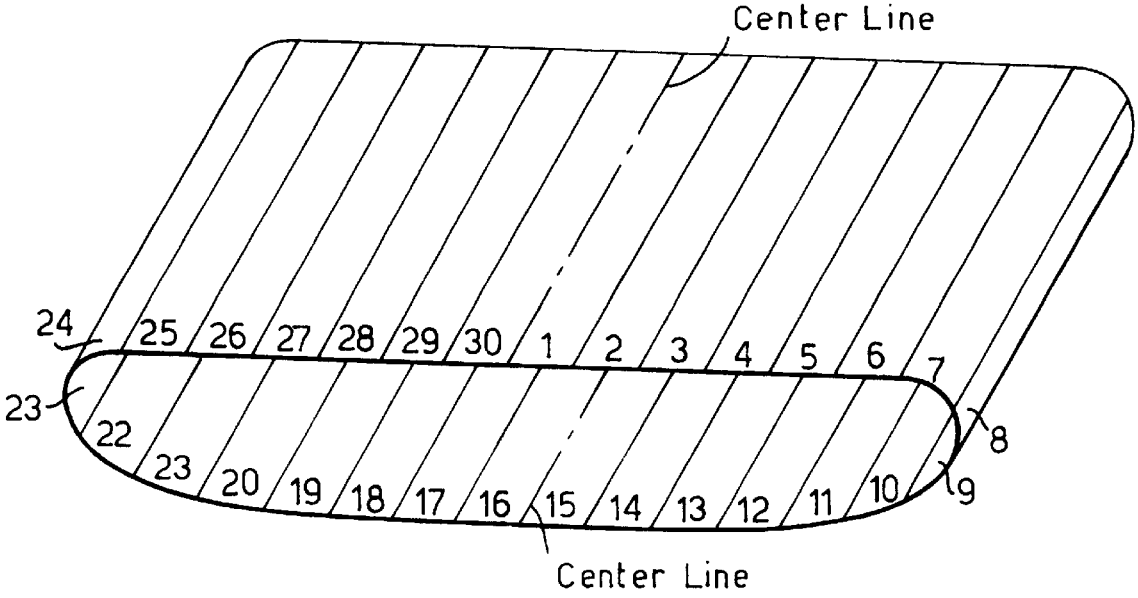
FIGS. 2A and 2B show the panels in one typical section of a fluid container according to an embodiment of the present invention, FIG. 2A being a perspective view and FIG. 2B being a cross sectional view.
Figure 2B:
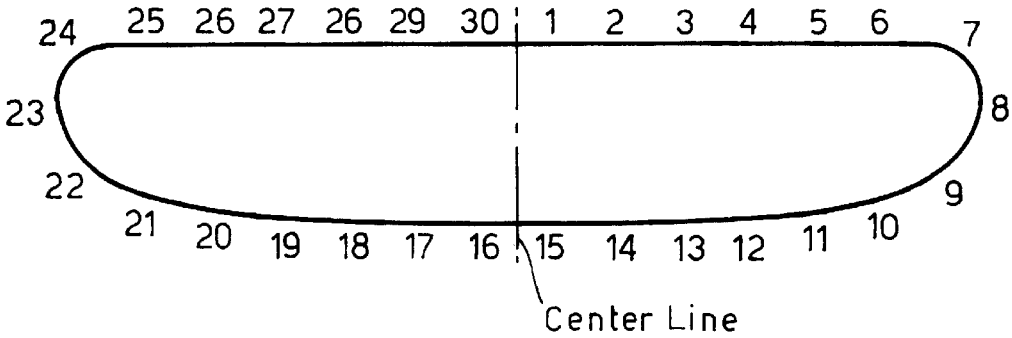

Each section may be comprised of a number of panels (1–30) which are generally rectangular in shape and oriented as shown in FIGS. 2A and 2B. The panels may e.g. be made of a fabric, suitably coated both internally and externally, and be joined as disclosed in International Patent Application Number PCT/NO97/00145 ("A lap joint between fabrics and a method of joining weldable fabrics", Christensen, et al.). Alternatively, each section may be made as one integral, seamless piece.

The bag 100 according to the preferred embodiment, comprises the following sections joined consecutively: A front section 110 joined by a section seam joint 200 to a forward tapered section 111, a first central section 112, a second central section 113, a central third section 114, a rearward tapered section 115, and an aft section 116, terminating the bag at the second end.

Figure 3:
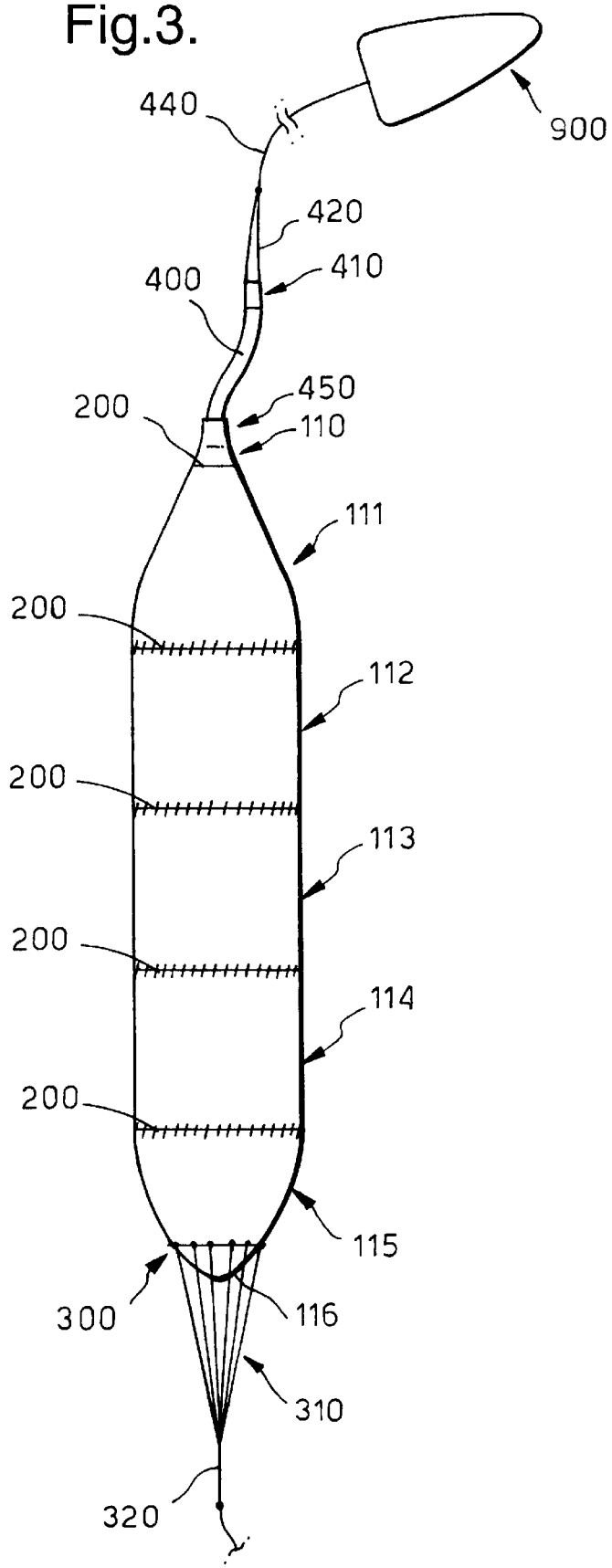
FIG. 3 is a plan view of the fluid container of FIG. 1 in a towing configuration, also showing the sections joints, hose and ancillary equipment, according to an embodiment of the present invention.

All of the consecutively joined sections are joined by each one of section seam joints 200, where the seam string 220 is indicated by the diagonal lines in FIG. 3, the exception being the rearward tapered section 115 and aft section 116, which may be joined by a number of clamps 300. Alternatively, the clamps may be replaced by individual pieces of string 220, which will be described later.

Figure 5A:
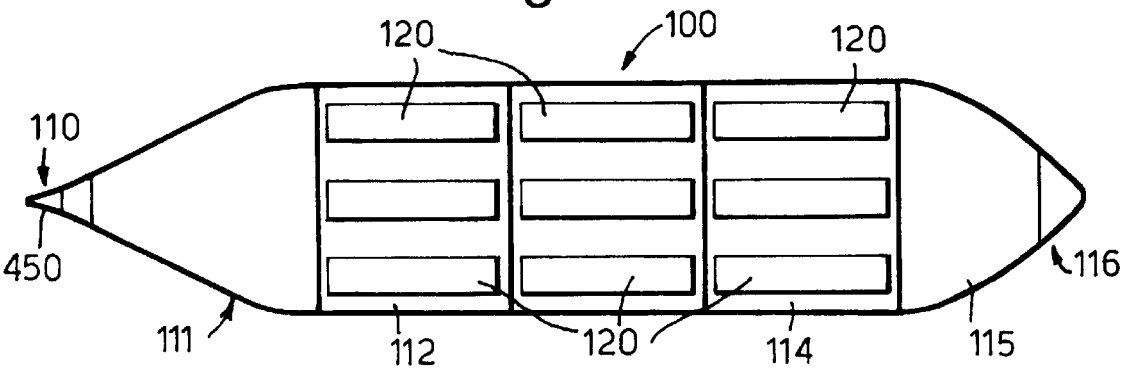
FIGS. 5A and 5B show plan- and cross-sectional views, respectively, of a bag according to embodiment of the present invention, where some of the bag sections are equipped with buoyancy elements.
Figure 5B:
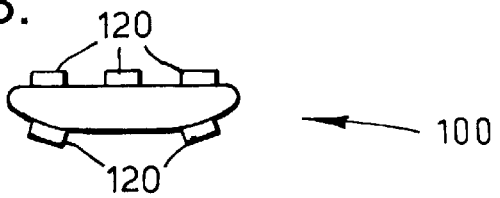
Figure 4A:
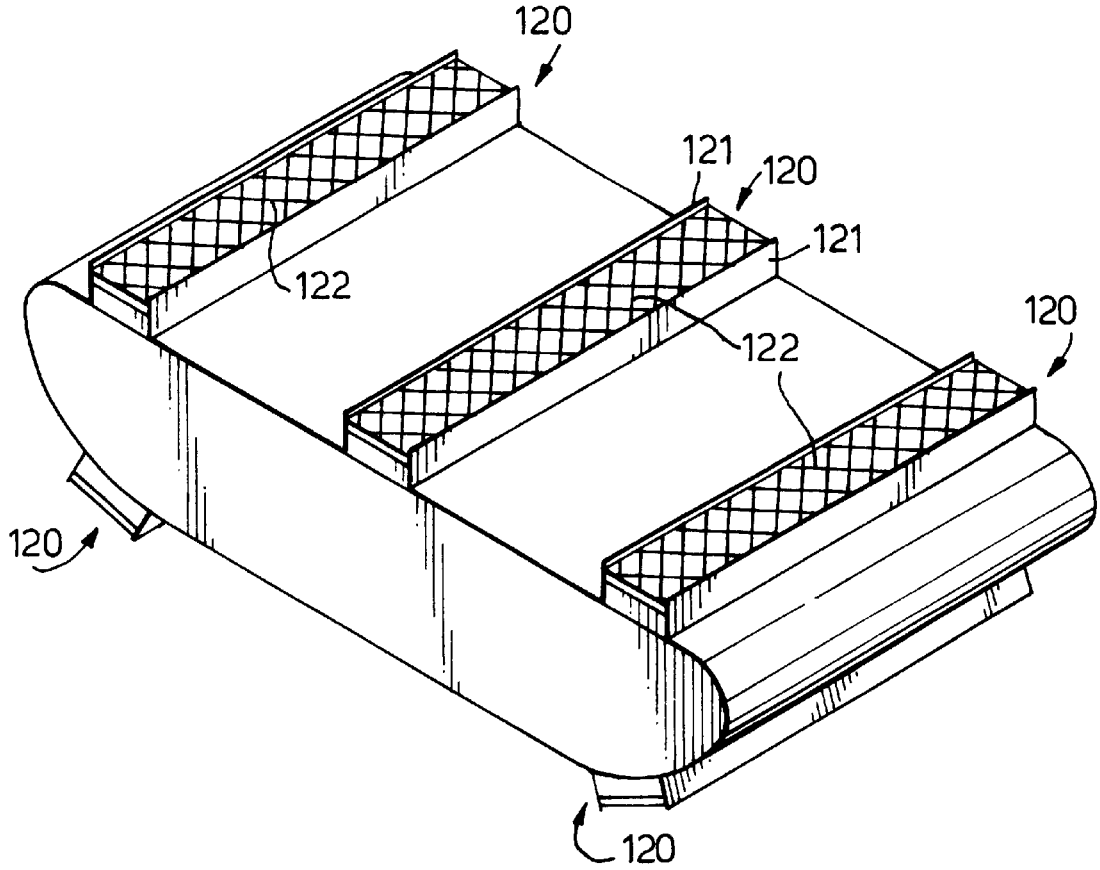
FIGS. 4A and 4B show a typical bag section according to an embodiment of the present invention, FIG. 4A being a perspective view and FIG. 4B being a cross sectional view, where the section is equipped with buoyancy elements.
Figure 4B:
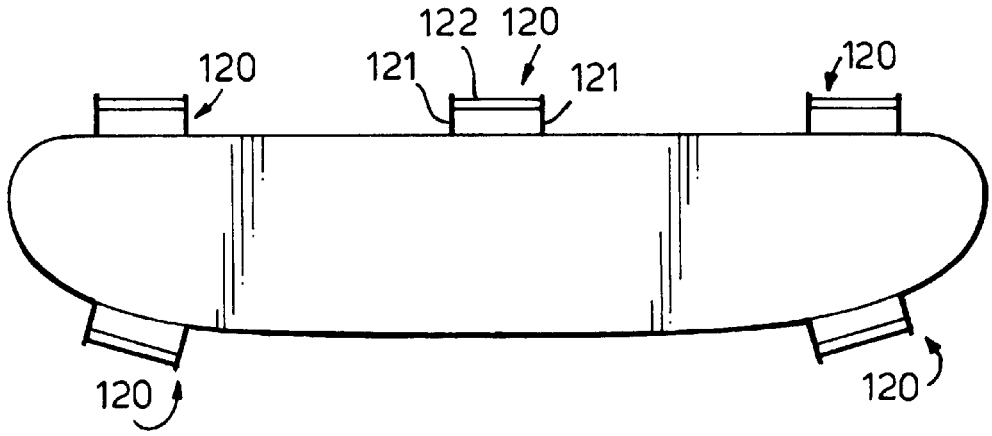

In order to preventing the bag from sinking down into the sea after the bag has been emptied of, or before it has been properly filled with, fresh water, the bag sections may be equipped with rectangular buoyancy elements 120 (FIG. 4). FIG. 4A is a perspective view, and FIG. 4B a cross sectional view of a bag section comprising pairs of longitudinal plate elements 121, between which rectangular buoyancy elements 120 are fitted and retained by a string arrangement 122, For clarity of illustration, the elements are shown in sizes that are larger than the actual sizes. Also, only five elements are shown, while the actual number of elements my be increased or decreased. FIGS. 5A and 5B show plan- and cross sectional views, respectively, of the buoyancy element arrangement described above.

Figure 6A:
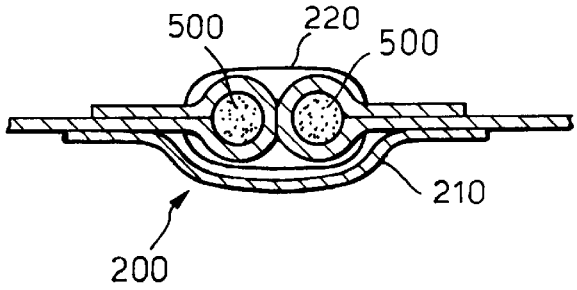
FIGS. 6A and 6B are cross sectional views of the section seam joint of FIG. 3, according to an embodiment of the present invention where

Each section seam joint 200, which is shown in cross section in FIG. 6A, comprises a rope or wire 500 in each abutting section end, where the ropes may be fastened to the respective section edge by the edge being folded back and enclosing the rope, and may be fastened to the section fabric as e.g. disclosed in the aforementioned International Patent Application. Still referring to FIG. 6A, the two sections are joined by a string 220 running through holes in the section fabric and entwining the two ropes 500. The string pulls the two sections ends together and creates a sealed joint. The string may run around the entire section or, alternatively, be terminated at regular intervals around the section circumference. The holes in the fabric, through which the string runs, may be circumferentially spaced in any suitable fashion.

Figure 6B:
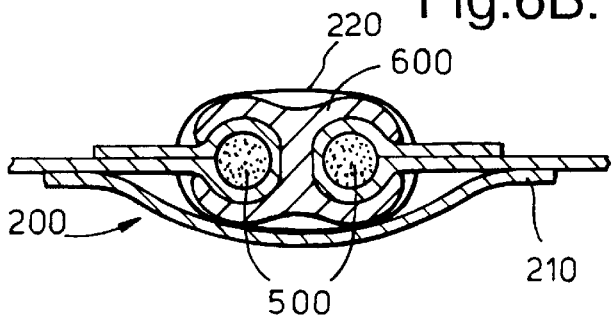

As an alternative, an additional sealing means, a sealing profile 600 may be introduced between the two abutting sections edges, as shown in FIG. 6B. In order to provide an additional seal, a sealing strip 210, preferably made of the same material as the sections, is welded to the water bag interior side, completely covering the seam.

Figure 7A:
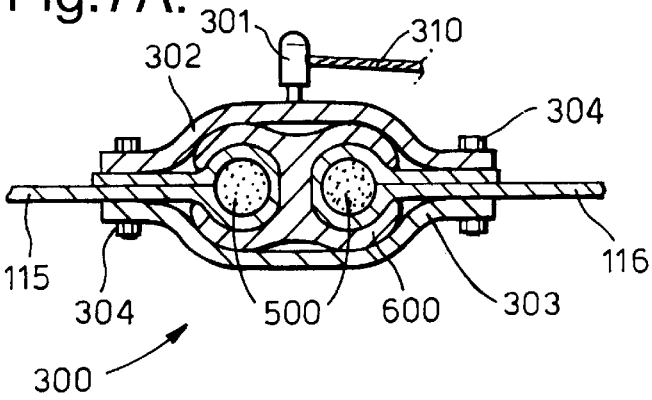
FIGS. 7A, 7B and 7C are cross sectional views of the section rear joint of FIG. 3, according to various embodiments of the present invention.
Figure 7B:
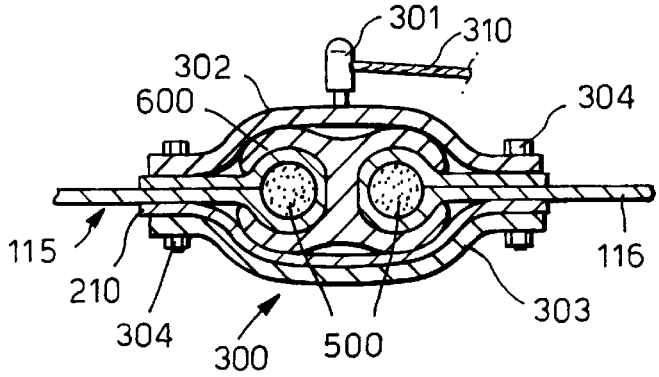

The section rear joints 300 are provided between the rearward tapered section 15 and the aft section 116. FIGS. 7A and 7B show these joints as being clamp joints. The clamps act as rear attachment points for retarder- and/or mooring lines 310. As indicated in FIG. 3, a number of lines 310, uniformly distributed around the rear of the bag, is preferred in order to distribute the pulling loads as uniformly as possible around the section joint. The lines 310 converge to be attached to tug line 320, which in turn may be releaseably connected to a tug 900 or a mooring point.

Figure 7C:
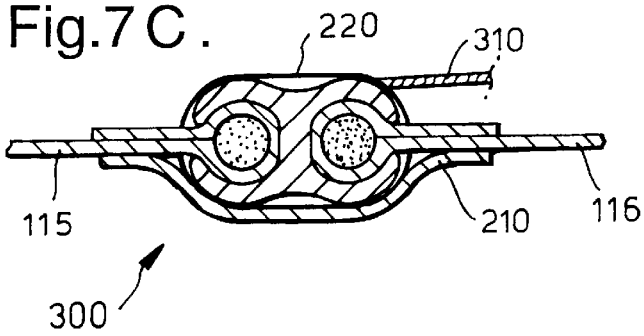

FIGS. 7A, 7B and 7C are cross sections of the rear joint 300. As with the section seam joint 200, the rear joint comprises a rope, wire or webbing 500 in each abutting section end, fastened to each section edge as described above. A sealing profile 600 is interposed between the two abutting sections edges, providing an additional sealing means. The two bag sections are joined by an exterior clamp half 302 and an interior clamp half 303, held together by any mechanical fastener means 304 (FIGS. 7A, 7B). The exterior clamp half is provided with a towing ring 301, to which the aforementioned lines 310 are attached. As an alternative, the clamped connection may be replaced by strings terminated at regular intervals around the bag section circumference (FIG. 7C).

Referring again to FIG. 3, the front section 110 connects to a flexible hose 400, which—in addition to being used for filling into and discharging fluids from the bag—also possesses the structural integrity sufficient for serving as the towing device. The hose is connected to a valve/connector unit 410, to which are connected a number (preferably 2) of towing lines 420. The towing line connects to a tug line 440, which is connected to the main tug 900 (or other propulsive means) for transportation, or may also be connected to a mooring point.

Figure 8:
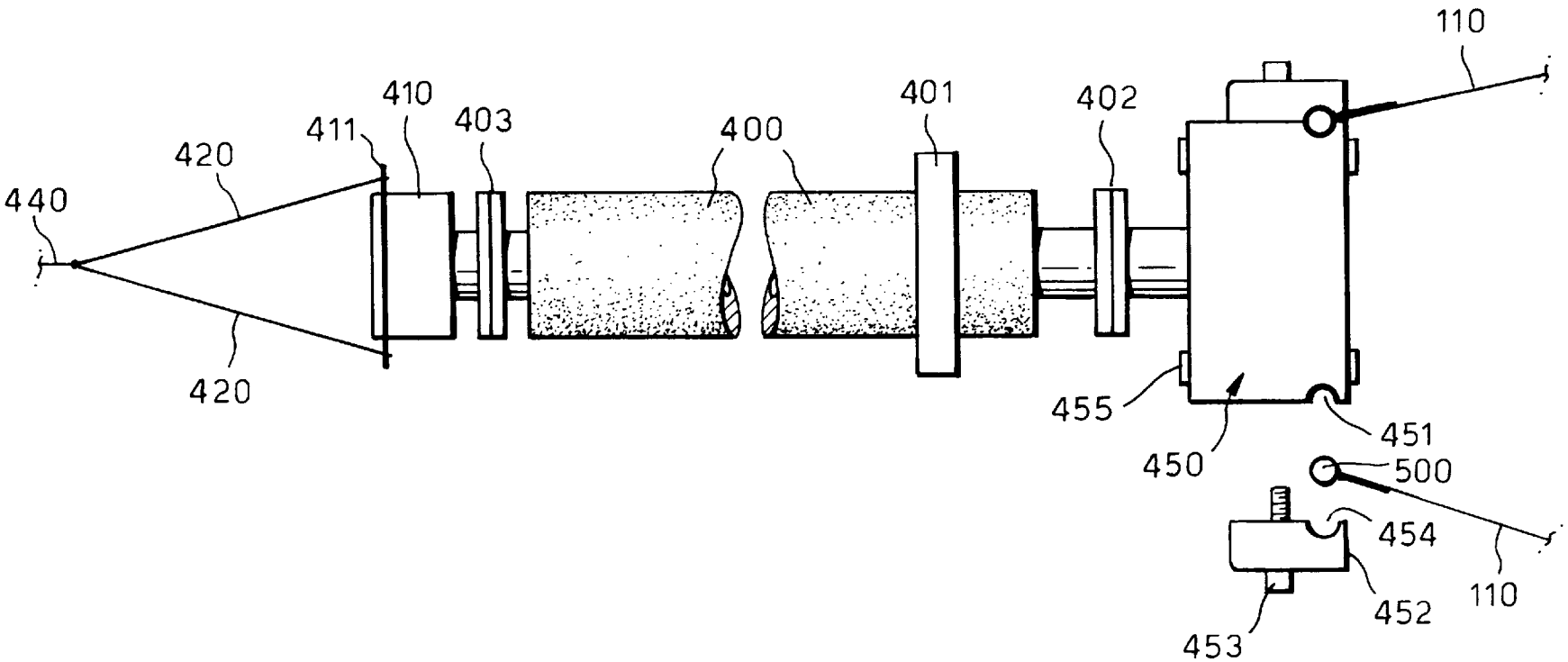
FIG. 8 is a side view of the flexible hose, including the bag junction element, valve and towing gear, according to an embodiment of the present invention.

FIG. 8 shows the hose/towing device in better detail. A junction element 450, comprising an adequate number of escape valves 455, is connected to the front section 110 by means of a number of clamp assemblies 452, 453, 454. Only two are shown. The rope 500, fastened to the front edge of the front section 110 in a manner described in the foregoing, is received in a circumferential groove 451 on the junction element 450 and sealably fastened by means of the clamp assemblies. Still with reference to FIG. 8, the junction element is connected to the flexible hose 400 by e.g. a conventional flange connection 402. The hose 400 which may be of any suitable length, comprises preferably an outer wall of a buoyant material, but may also and/or in addition be fitted with buoyancy elements. Only one such element 401 is indicated.

Figure 9:
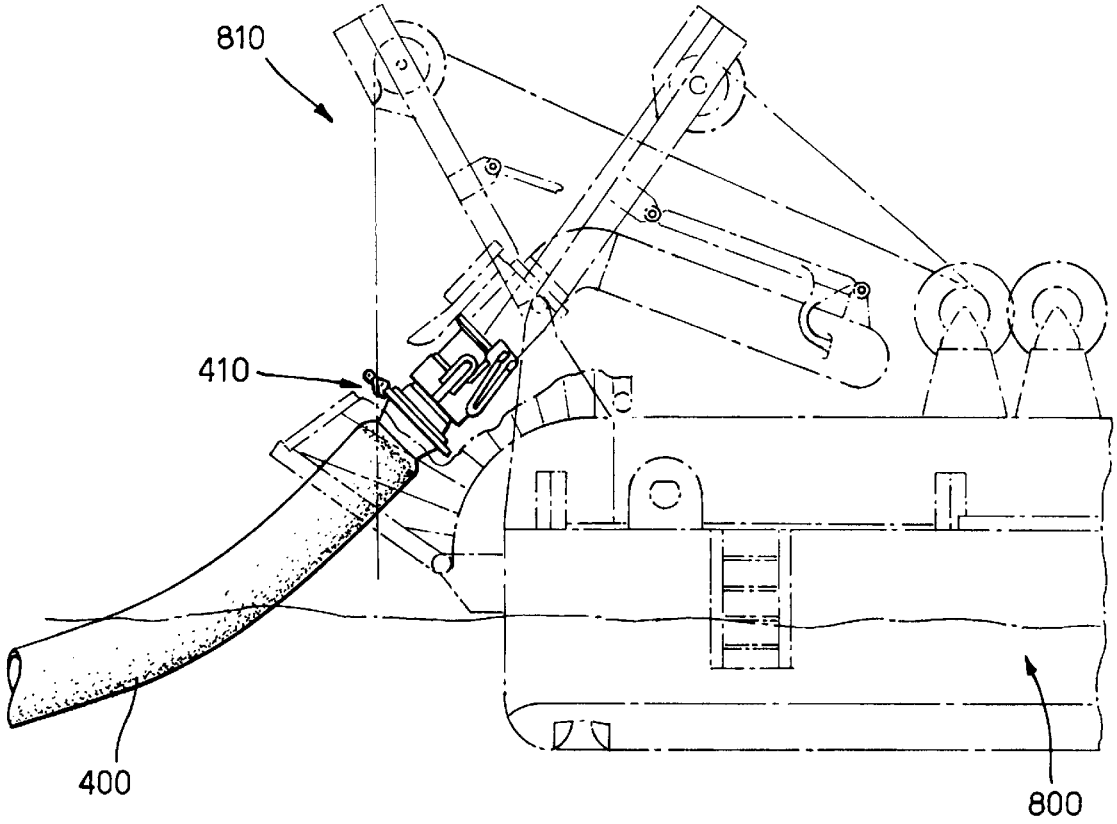
FIG. 9 is a schematic side view of a filling/discharge facility (shown partly), according to embodiment of the present invention.

The hose is in its front end connected via an e.g. conventional flange connection 403, to a valve and connector element 410. This element comprises a valve (e.g. ball valve, butterfly valve, etc.) which serves as the water bag closure device. In addition, the valve/connector element 410 is equipped with a number of towing lines attachment points or towing rings 411. Referring now to FIG. 9, upon connection to the filling/discharge facility 800, the hose is pulled by the valve/connector element onto the facility platform, where the element 410, via a pull-in and connection assembly 810, is connected to filling/discharge lines.

Figure 10:
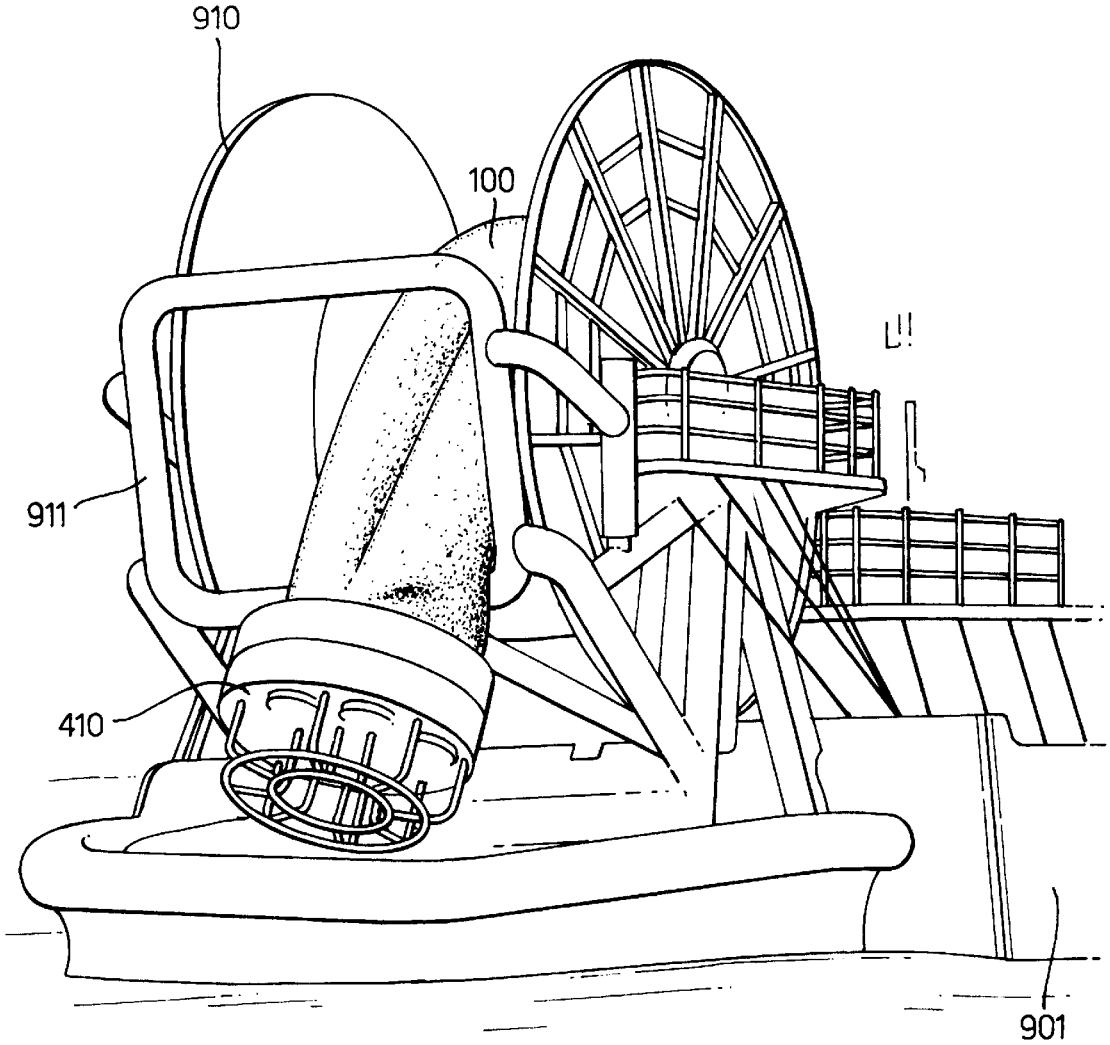
FIG. 10 is a perspective illustration of the aft part of the tug, showing e.g. the bag storage drum and guide frame.

When the water bag has been emptied, the full length of the bag is reeled onto a bag storage drum 910 mounted on the stem part of a vessel (e.g. the tug 900), as indicated in FIG. 10. The bag is reeled onto the drum 910 (by conventional motor means), through the guide frame 911, by the tug line 320. The guide frame is positioned relative to the drum or reel such that it serves as a passive alignment device for the vessel during container deployment and retrieval, thus rendering other alignment devices or methods (e.g. use of lateral thrusters) superfluous.

When the empty bag is completely stored on the drum, the valve and connector element 410 is hanging off the guide frame as shown in FIG. 10, and the vessel may transport the bag to a filling facility. When the bag is to be filled, it is pulled off the drum by means of the element 410, as described above, It is thus advantageous to employ the system described above when emptying and retrieving (onto the drum) the water bag. While the bag is attached to an emptying facility and emptying may be in progress, the rear end of the bag is attached (via lines 310, 320) to the bag storage drum 910. Coordinated with the discharge of fresh water through the hose, the bag is spooled onto the drum. Simultaneously, the tug will be backing up towards the facility. When the bag is sufficiently empty, the hose is released from the emptying facility and the part of the bag and said hose still in the water are completely retrieved onto the drum. This method ensures that the effectively entire volume of fresh water is emptied from the bag, and it prevents the bag from sinking down into the sea and onto the seabed where the bag may be damaged.

A generally reverse procedure is employed when the bag is to be deployed from the drum and refilled with fresh water. Again, an empty bag in the sea is difficult to control and is susceptible to damage as it (e.g.) may sink to the seabed Thus, to ensure a controlled deployment and filling method, the hose is pulled off the drum and connected to the filling facility. As the fresh water makes its way through the hose and into the bag, the bag is reeled off the drum by conventional motor means in a fashion that is coordinated with the fresh water filling. Simultaneously, the tug advances away from the filling facility by the time the bag is sufficiently filled with fresh water, it is fully deployed off the drum and into the sea. The rear attachment lines 310, 320 are cast off and the filled bag is floating in the sea.

For towing the filled bag to its destination, the connector element 410 is released from the filling facility as described above. A tug 900 connects via lines 440, 420 to the connector element 410. Thus the bag is towed by the tug pulling the flexible hose 400, which is attached to the bag first end.

The foregoing description of an embodiment of the system and method in accordance with the invention, thus illustrates a bag for the storage and/or transportation of fluids, such as e.g. fresh water; where the bag may be towed by means of the flexible filler/discharge hose. The bag is modularized, thus facilitating convenient and quick repair procedures, in that individual sections easily may be replaced.

The foregoing description and the embodiments of the present invention are to be construed as mere illustrations of the application of the principles of the invention. The system and methods in accordance with invention are equally applicable to any bag material, coatings, shape, size, volunme, number of sections, number of panels, panel joining means, and section joining means. Also, although the system and methods described in the preferred embodiment primarily is intended for the transport of fresh water, the present invention is equally applicable for any fluid. None of the foregoing is intended to limit the scope of the claims, but the true spirit and scope of present invention is defined by the claims.

What is claimed is:

1. An improved, modularized system for storing and conveying fluids, said system being adapted for towing by marine crafts in offshore conditions, said system comprising:

a collapsible fluid container having an elongate shape and first and second ends;

a fluid filling and emptying conduit attached to said container first end;

towing/mooring means attached to said conduit;

retarder/mooring means attached to said container second end; and container retrieval, storage and deployment means, wherein said container is composed of a front section, a forward tapered section, a plurality of central sections, a rearward tapered section, and an aft section, said sections being joined consecutively in a container longitudinal direction.

2. The system in accordance with claim 1, wherein said sections comprise a plurality of buoyancy means, externally affixed to said sections by attachment means.

3. The system in accordance with claim 1, wherein said sections are joined by circumferentially extending section joining means.

4. The system in accordance with claim 1, wherein said sections are sealed by sealing means interposed between said abutting section ends.

5. The system in accordance with claim 3, wherein said sections each comprise circumferentially extending ropes, wires or webbed structures fixedly circumferentially attached to respective ones of said section, said rope or wire being attached at any section end abutting a proximal one of a said other section end.

6. The system in accordance with claim 5, wherein said section joining means comprise a string penetrating said section wall proximal to said respective section ends and entwining said respective abutting section ends, said string thereby sealably and flexibly joining said respective abutting sections.

7. The system in accordance with claim 6, wherein said scaled and flexible section joints between said respective abutting sections further comprise flexible sealing means fixedly attached to the container interior and enclosing said string entwining said respective abutting section ends, thereby providing an additional sealing means.

8. The system in accordance with claim 1, wherein said fluid conduit comprises a valve means between said container first end and said towing/mooring means.

9. The system in accordance with claim 8, wherein said valve means further comprises a connector means for connecting said container to at least one of a container filling and emptying facility;

wherein said towing/mooring means comprise a plurality of attachment means for towing and mooring, fixedly attached to said valve and connector means; and wherein said conduit further comprises a junction element connected to said front section, and a flexible portion fixedly attached to and between said valve means and said junction element.

10. The system in accordance with claim 9, wherein said flexible portion is a hose comprising a plurality of buoyancy elements.

11. The system in accordance with claim 9, wherein said towing/mooring means further comprises a plurality of towing and mooring lines attached to said plurality of attachment means.

12. The system in accordance with claim 8, wherein said conduit is fixedly attached to said front container section by means of a junction element and another plurality of attachment means.

13. The system in accordance with claim 1, wherein said retarder/mooring means comprise a rear section joint, comprising joining means circumferentially disposed towards said container second end and joining said aft section to said rearward tapered section;

said section joining means enclosing respective parts of respective abutting ends of said aft and rearward tapered sections, both said abutting ends being received in designated recesses in an interposed sealing means, thereby forming a sealed joint between said rearward tapered section and said aft section.

14. A The system in accordance with claim 13, wherein said rear section joining means comprise interior and exterior section joining means.

15. The system in accordance with claim 14, wherein said interior and exterior section joining means are clamps being mutually affixed by fastening means.

16. The system in accordance with claim 13, wherein said rear section joining means comprise string means.

17. The system in accordance with claim 14, wherein a plurality of towing/mooring and retarding/mooring means are fixedly attached to a respective one of a plurality of said exterior section joining means and wherein a plurality of towing/mooring and retarding/mooring lines are attached to a respective one of said plurality of towing/mooring and retarding/mooring means.

18. The system in accordance with claim 2, wherein said retrieval, storage and deployment means is removeably mountable on a vessel intended for the transportation of said container in an empty state; said retrieval, storage and deployment means comprising means for guiding said fluid container onto and off of said retrieval, storage and deployment means.

19. The system in accordance with claim 18, wherein said container guiding means is positioned relative to the retrieval, storage and deployment means such as to serve as a passive alignment means for said vessel during container deployment and retrieval.

20. An improved system for towing collapsible, floating, fluid containing containers, said system comprising:

a fluid filling and emptying conduit attached to said container's first end, and towing means attached to said conduit, wherein said conduit comprises:

a plurality of buoyancy elements;

valve and connector means for connecting to a facility for filling a fluid into and discharging a fluid from said container;

a plurality of attachment means for towing and mooring, fixedly attached to said valve and connector means;

a junction element; and a flexible portion fixedly attached to and between said valve and connector means and said junction element.

21. The system in accordance with claim 20, wherein said conduit, by means of said valve and connector element, is pulled onto a connection facility for connecting to means for filling and/or discharging said container.

22. A method for emptying and retrieving a collapsible fluid container filled with a volume of fresh water and having an elongate shape and a first and a second end, and comprising:

a fluid filling and emptying conduit attached to said container first end; towing/mooring means attached to said conduit; and towing/mooring means attached to said container second end, said method comprising;

while said conduit is attached to an emptying facility, attaching said container second end to a container retrieval, storage and deployment means removeably mountable on a vessel intended for the transportation of said container in an empty state;

coordinated with the discharge of said fresh water through said conduit, reeling said container onto said retrieval, storage and deployment means;

coordinated with the reeling of said container onto said retrieval, storage and deployment means, propelling said vessel in a direction generally towards said facility; and when said container is sufficiently empty, releasing said conduit from said facility, thereby enabling the part of said container and said conduit still in the water to be completely retrieved onto said retrieval, storage and deployment means, whereby said method effectively causes virtually said entire volume of fresh water to be emptied from said container.

23. A method for deploying of, and filling with a volume of fresh water, a collapsible fluid container having an elongate shape and a first and a second end, and comprising:

a fluid filling and emptying conduit attached to said container first end;

towing/mooring means attached to said conduit; and towing/mooring means attached to said container second end, said method comprising:

pulling said conduit off a container retrieval, storage and deployment means removeably mountable on a vessel intended for the transportation of said container in an empty state;

connecting said conduit to a filling facility and commencing a filling of fresh water thorough said conduit and into said container;

coordinated with the filling of said fresh water through said conduit, reeling said container off said retrieval, storage and deployment means;

coordinated with the reeling of said container off of said retrieval, storage and deployment means, propelling said vessel in a direction generally away from said facility; and when said container is sufficiently filled with fresh water, releasing said container second end from of said retrieval, storage and deployment means.

* * * * *